US005879513A

United States Patent [19]

Karvinen

[11] Patent Number: 5,879,513

[45] Date of Patent: Mar. 9, 1999

[54] METHOD AND APPARATUS FOR THE DRAINAGE OF THE WIRE AND/OR PRESS SECTION OF A PAPER MACHINE

[75] Inventor: Juha Karvinen, Huutjärvi, Finland

[73] Assignee: Ecopump Oy, Kotka, Finland

[21] Appl. No.: 817,322

[22] PCT Filed: Sep. 22, 1995

[86] PCT No.: PCT/FI95/00521

§ 371 Date: Apr. 7, 1997

§ 102(e) Date: Apr. 7, 1997

[87] PCT Pub. No.: WO96/12064

PCT Pub. Date: Apr. 25, 1996

[30] Foreign Application Priority Data

Oct. 12, 1994 [FI] Finland ..... 944796

[51] Int. Cl.[6] ..... D21F 1/48

[52] U.S. Cl. ..... 162/198; 162/190; 162/263; 162/DIG. 7; 162/364; 162/262

[58] Field of Search ..... 162/198, 190, 162/263, 264, 903, DIG. 7, DIG. 11, DIG. 10, DIG. 363, DIG. 364, DIG. 262

[56] References Cited

U.S. PATENT DOCUMENTS

| | | | |
|---|---|---|---|
| 1,633,189 | 6/1927 | Poirier | 162/364 |
| 2,877,693 | 3/1959 | Poirier | 162/364 X |
| 3,005,490 | 10/1961 | Justus | 162/364 X |
| 3,024,839 | 3/1962 | Beachler | 162/364 |
| 3,066,068 | 11/1962 | Calehuff et al. | 162/364 X |
| 3,463,700 | 8/1969 | Brewster et al. | 162/363 X |
| 4,329,201 | 5/1982 | Bolton | 162/198 |
| 4,891,098 | 1/1990 | Renjilian et al. | 162/198 |
| 5,011,577 | 4/1991 | Hansen et al. | 162/352 |
| 5,076,890 | 12/1991 | Balembois | 162/198 |

FOREIGN PATENT DOCUMENTS 77706 12/1988 Finland .

*Primary Examiner*—Stanley S. Silverman
*Assistant Examiner*—José A. Fortuna
*Attorney, Agent, or Firm*—Baker & Botts, L.L.P.

[57] ABSTRACT

Procedure for the drainage of the wire and/or press section of a paper machine, in which procedure at least one suction pipe (1) is provided with at least one gap (2) and the suction pipe (1) is connected to a vacuum device (4) to develop a vacuum at least in this vacuum pipe, and in which procedure a felt, wire or equivalent (3) is moved over the gap of the suction pipe, water being thus drained from the felt, wire or equivalent. In the procedure, the vacuum capacity is adjusted by measuring and/or adjusting at least the amount of water drained from the suction pipe (1) and, on the basis of the measured data, adjusting the vacuum capacity by means of regulating devices (11, 12). The invention also relates to an apparatus for adjusting the vacuum capacity.

13 Claims, 1 Drawing Sheet

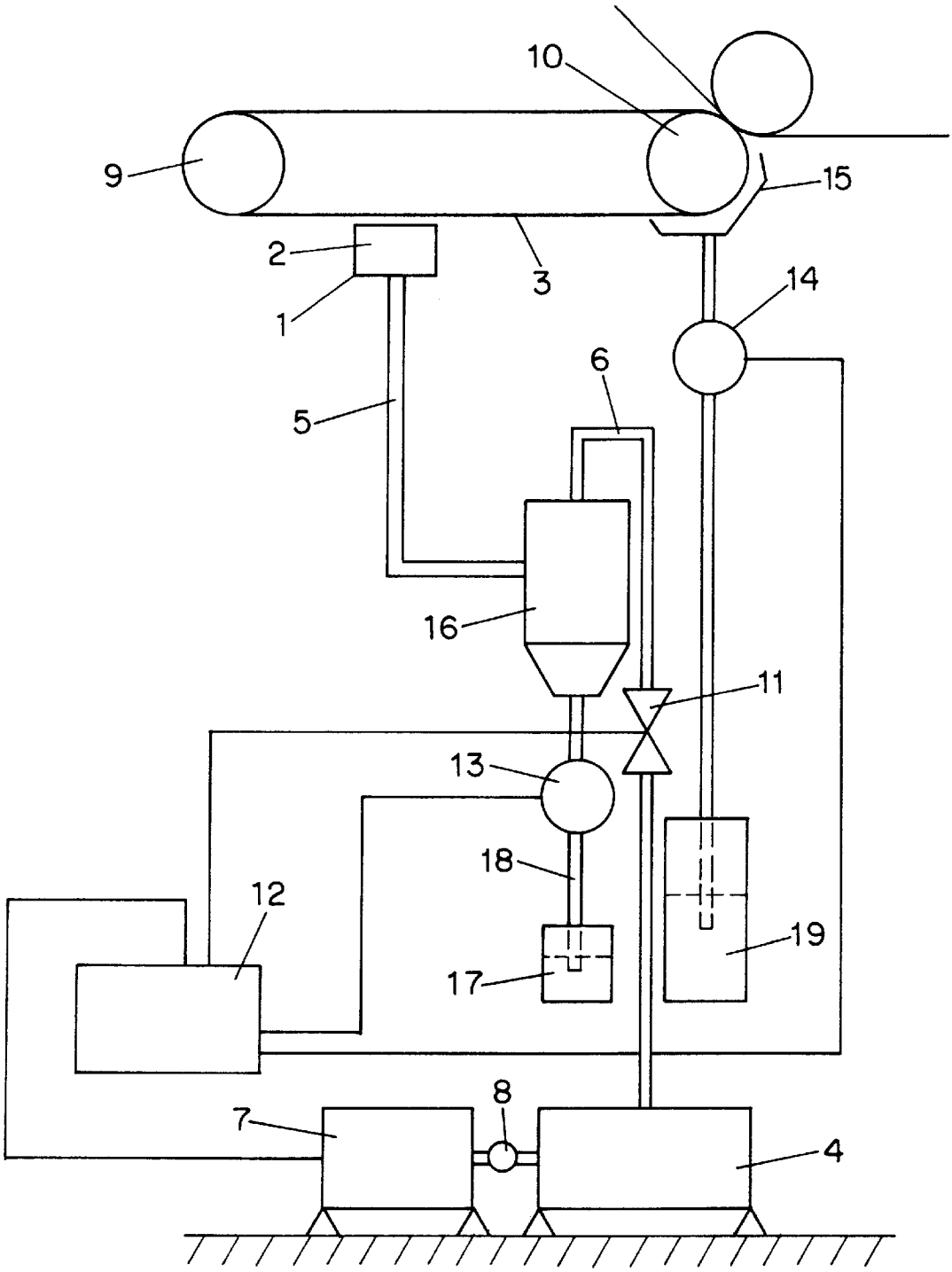
10
9
15
2
3
14
1
6
5
16
11
13
18
12
19
17
8
7
4

METHOD AND APPARATUS FOR THE DRAINAGE OF THE WIRE AND/OR PRESS SECTION OF A PAPER MACHINE

This application is a 371 of PCT/F/95/00521 filed Sep. 22, 1995.

SPECIFICATION

The present invention relates to a procedure and to an apparatus for the drainage of the wire and/or press section of a paper machine.

BACKGROUND OF THE INVENTION

In the paper industry, drainage is implemented using suction pipes, suction boxes, suction rollers or equivalent provided with longitudinal gaps or holes against a wire screen, felt or equivalent which carries the wet web of paper. Each suction pipe is so placed that the wire, felt or equivalent passes over the gap or holes and drying is effected as the water is hurled by a centrifugal force into the roller trough. The water is gathered in the suction pipe and passed to a suitable collecting place. An apparatus of this type is presented in Finnish patent publication 77706 (Corres. to U.S. Pat. No. 4,329,201). In current systems, the vacuum is adjusted on the basis of pressure, by using various valve elements or by varying the rotational speed of a pump unit to maintain a desired pressure. Of the processes in a paper machine, the vacuum system is responsible for the highest power consumption. It also has an effect on the driving output and steam consumption of the press and wire section. In the solutions currently used, the adjustment of the vacuum capacity affects the negative pressure, but it has not been possible to reliably determine the effect of the adjustment on the drainage of the paper machine. An excessively high vacuum level is not beneficial to drainage. Instead, it increases the pumping costs and the costs resulting from the wear of fabrics and consumption of energy caused by increased friction.

The object of the present invention is to achieve a completely new solution that allows the drawbacks of known technology to be avoided.

SUMMARY OF THE INVENTION

The invention is based on an idea according to which the vacuum capacity is adjusted on the basis of water volume measurements with the aid of preprogrammed data.

The solution of the invention has numerous significant advantages. It makes it possible to control the drainage of a paper machine so that an optimal drainage situation is reached, with the result that the solids content e.g. after the press section is maximized. Therefore, maximal drainage for the wire and felt type in use is achieved. The runnability of the paper machine is improved. An adjustable vacuum system allows considerable savings to be made in energy consumption and has advantageous effects on paper quality.

BRIEF DESCRIPTION OF THE DRAWING

In the following, the invention is described by referring to the attached drawing FIG. 1, which is a diagrammatic representation of an apparatus as provided by the invention.

DESCRIPTION OF THE PREFERRED EMBODIMENT

The figure shows a simplified form of an apparatus for the drainage of the wire and/or press section of a paper machine.

The apparatus comprises at least one suction pipe 1 having at least one gap or inlet 2 over which the felt, wire or equivalent web carrier 3 passes, vacuum elements 4, piping elements 5, 6 connecting the suction pipe 1 to the vacuum elements 4, drive elements 7, 8 for operating the vacuum devices 4 and creating a vacuum in the suction pipe, and elements 9, 10 for moving the felt, wire or equivalent over the suction pipe, thereby developing a vacuum for the drying of the felt, wire or equivalent. The apparatus is provided with regulating elements 11, 12 for the adjustment of the vacuum capacity and at least one element 13 located at least below the suction pipe for the measurement and/or adjustment of the amount of water drained, on the basis of which the vacuum capacity is adjusted by means of the regulating elements.

'Vacuum capacity' refers to a value which equals negative pressure (p) * pump yield value (Q).

The suction pipe 1 is placed in the apparatus in a manner known in itself and it has a gap or inlet 2 that opens towards the felt, wire or equivalent web carrier 3 passing over it. Connected to the suction pipe 1 is a pipe 5 whose one end communicates with the hollow space of a separator 16. From the lower end of the separator, a pipe 18 extends downwards to a container 17. The water flows in the pipe 18 under the influence of gravity. Alternatively, a centrifugal pump (not shown) can be mounted in conjunction with the pipe 18, constituting a so-called extraction pump system. A pipe 6 starting from the upper end of the separator is connected at its other end to the vacuum element 4, preferably a vacuum pump. The pump 4 is operated by means of the drive elements 7, 8.

The regulating elements consist of a control unit 12 and at least one valve element 11. The control unit 12 is preferably a process computer or equivalent. The valve element 11 preferably consists of at least one throttle valve and/or a replacement air valve. The valve element 11 is placed in the piping between the suction pipe 1 and the vacuum device 4 preferably near the suction pipe, most preferably in the pipe 6 between the pump 4 and the separator 16.

The apparatus comprises a collecting element 15, preferably a so-called nip water trough, into which the water is hurled by a centrifugal force.

The apparatus is preferably provided with measuring element 14 in addition to measuring element 13 for the measurement of the amount of water drained. The measuring element 13 that measures the amount of water drained from the suction pipe 1 is preferably placed in pipe 18 between the separator 16 and the container 17 or the like. The measuring element 14 that measures the amount of water drained from the collector element 15 is preferably placed in the pipe between the collector element 15 and a container 19 or the like.

The control unit 12 may consist e.g. of a process computer connected to receive the data supplied by the water meters 13, 14 and to adjust the vacuum capacity on the basis of these data. The adjustment of the vacuum capacity is controlled on the basis of information adjusted according to the water measurements or on the basis of preprogrammed information. The control unit preferably regulates the valve element 11 and/or the drive 7 of the pump 4. The vacuum capacity is adjusted in the suction piping by means of the valve element 11 and/or periodic operation of the pump 4 and/or by adjusting the speed of rotation of the vacuum pump 4 and/or by varying the rotational speed of the centrifugal fan or the position of the static vanes on its suction and pressure sides. With the solution of the invention, the ratio of the amounts of water drained from the suction pipe 1 and the collecting element 15 can be adjusted or programmed.

It is obvious to the person skilled in the art that the invention is not restricted to the application example described above, but that it may instead be varied within the scope of the following claims.

I claims:

1. A method for draining an amount of water from the wire and/or press section of a paper machine including a carrier for a wet web of paper, at least one roller over which the carrier passes, at least one suction pipe having at least one inlet adjacent the carrier, and a vacuum device, having a vacuum capacity, connected to the suction pipe for developing a vacuum in the suction pipe, the method comprising the steps of:

draining a first amount of water from the web carrier through the suction pipe;

determining first data representative of the first amount of water drained;

draining by centrifugal force a second amount of water from said roller into a collecting element;

determining second data representative of the second amount of water drained; and adjusting the vacuum capacity based on the first and second data so as to control overall drainage from the machine.

2. The method of claim 1 wherein the adjusting step comprises, at least in part, adjusting the vacuum capacity in the suction pipe by adjusting at least one valve element disposed between the suction pipe and the vacuum device of the paper machine.

3. The method of claim 1 wherein the adjusting step comprises periodically operating the vacuum device.

4. The method of claim 1 wherein the adjusting step comprises adjusting the rotational speed of the vacuum device.

5. The method of claim 1 wherein the adjusting step comprises varying the rotational speed of a centrifugal fan disposed below the suction pipe.

6. The method of claim 1 wherein the adjusting step comprises adjusting the vacuum capacity according to preprogrammed data.

7. The method of claim 6 wherein said preprogrammed data is based on a drainage ratio between water drained through the suction pipe and water drained into the collecting element, the ratio being adjustable by manual or automatic means.

8. The method of claim 1 wherein the adjusting step comprises adjusting the vacuum capacity by use of a control unit.

9. The method of claim 1 wherein the adjusting step comprises varying the position of the static vanes of a centrifugal fan on the suction and pressure sides of said fan.

10. An apparatus for draining the wire and/or press section of a paper machine, comprising:

a wet paper web carrier;

at least one roller over which the carrier passes;

at least one suction pipe having at least one inlet over which the carrier passes;

a water collecting element disposed below the roller;

at least one vacuum device, having a vacuum capacity, connected to the suction pipe by one or more pipe elements;

means for moving the web carrier over the inlet of the suction pipe for drying a paper web carried by the carrier;

means connected to said pipe elements for determining first data representative of an amount of water drained from the suction pipe;

means connected to said collecting element for determining second data representative of an amount of water flowing from the collector element; and means connected to said vacuum-device for adjusting the vacuum capacity of the vacuum device, based on the first and second data.

11. The apparatus of claim 10 wherein the adjusting means comprises regulating devices.

12. The apparatus of claim 11 wherein the regulating devices comprise a control unit and at least one valve element.

13. The apparatus of claim 12 wherein the valve element comprises at least one throttle valve and/or a replacement air valve.

* * * * *